US010517789B1

(12) United States Patent
Petromallo

(10) Patent No.: US 10,517,789 B1
(45) Date of Patent: Dec. 31, 2019

(54) STANDING AID

(71) Applicant: Michael Petromallo, Ontario, NY (US)

(72) Inventor: Michael Petromallo, Ontario, NY (US)

( * ) Notice: Subject to any disclaimer, the term of this patent is extended or adjusted under 35 U.S.C. 154(b) by 0 days.

(21) Appl. No.: 15/944,252

(22) Filed: Apr. 3, 2018

(51) Int. Cl.
*A61H 3/02* (2006.01)
*A45B 9/04* (2006.01)
*A45B 9/02* (2006.01)

(52) U.S. Cl.
CPC ..... *A61H 3/02* (2013.01); *A45B 9/02* (2013.01); *A45B 9/04* (2013.01); *A61H 2003/0272* (2013.01); *A61H 2201/1638* (2013.01)

(58) Field of Classification Search
CPC .... A45B 9/02; A45B 9/04; A45B 7/00; A61H 3/00; A61H 3/02; A61H 3/0288; A61H 2003/005; A61H 2201/1638; A61H 2003/0283
USPC ..... 135/65–66, 68, 72, 77–78, 84; 482/51–52, 66, 70, 75; D3/5–17
See application file for complete search history.

(56) References Cited

U.S. PATENT DOCUMENTS 3,553,746 A * 1/1971 Seiger ..... A61G 7/053 135/67
4,062,372 A * 12/1977 Slusher ..... A45B 3/00 135/66
4,085,763 A 4/1978 Thomas
4,565,409 A 1/1986 Hollonbeck
4,688,789 A * 8/1987 Alter ..... A61H 3/02 135/71
4,763,756 A 8/1988 Horan
D307,666 S * 5/1990 Fisher ..... D3/13
5,390,687 A 2/1995 Tsai
5,421,115 A * 6/1995 McKay ..... F41A 23/12 248/163.1
5,533,536 A * 7/1996 Hong ..... A61H 3/02 135/65
5,806,548 A 9/1998 Goldstein
6,834,660 B1 12/2004 Van Wart, Jr.
7,188,634 B2 3/2007 Coakley, Sr.
7,647,937 B2 * 1/2010 Gordon ..... A45B 9/04 135/65
8,371,320 B1 * 2/2013 McKenna ..... A61H 3/02 135/71
8,888,188 B2 11/2014 Moffat
9,468,272 B1 * 10/2016 Hyde ..... A61H 3/02
10,172,468 B2 * 1/2019 Houghson ..... A47C 16/00
2002/0089227 A1 7/2002 Speraw
(Continued)

FOREIGN PATENT DOCUMENTS

WO 2016149707 A 9/2016

*Primary Examiner* — Winnie Yip

(57) ABSTRACT

The standing aid is a mobility assistance device. The standing aid is configured for use with a person. The person is further defined with a knee. The knee is further defined with a patella. The standing aid assists a person as the person moves in a manner selected from the group consisting of: 1) moving from a standing position to a kneeling position; and, 2) moving from a kneeling position to a standing position. The standing aid allows a person to transfer some of the load of their body to the supporting surface through a load path created by the standing aid. This transfer allows a person to more easily move in the selected manner. The standing aid comprises a stanchion, a plurality of supporting legs, and a handle. The plurality of supporting legs and the handle attach to the stanchion.

17 Claims, 5 Drawing Sheets

(56) References Cited

U.S. PATENT DOCUMENTS

| | | | | |
|---|---|---|---|---|
| 2009/0152413 | A1* | 6/2009 | Takegawa | G10D 13/026<br>248/170 |
| 2010/0206348 | A1* | 8/2010 | Markou | A61H 3/02<br>135/71 |
| 2017/0196322 | A1* | 7/2017 | Denmark | A45B 9/04 |

* cited by examiner

STANDING AID

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary science including patient accommodations, more specifically, a standing aid specially adapted for a patient.

SUMMARY OF INVENTION

The standing aid is a mobility assistance device. The standing aid is configured for use with a person. The person is further defined with a knee. The knee is further defined with a patella. The standing aid assists a person as the person moves in a manner selected from the group consisting of: 1) moving from a standing position to a kneeling position; and, 2) moving from a kneeling position to a standing position. The standing aid allows a person to transfer some of the load of their body to the supporting surface through a load path created by the standing aid. This transfer allows a person to more easily move in the selected manner. The standing aid comprises a stanchion, a plurality of supporting legs, and a handle. The plurality of supporting legs and the handle attach to the stanchion.

These together with additional objects, features and advantages of the standing aid will be readily apparent to those of ordinary skill in the art upon reading the following detailed description of the presently preferred, but nonetheless illustrative, embodiments when taken in conjunction with the accompanying drawings.

In this respect, before explaining the current embodiments of the standing aid in detail, it is to be understood that the standing aid is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the standing aid.

It is therefore important that the claims be regarded as including such equivalent construction insofar as they do not depart from the spirit and scope of the standing aid. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
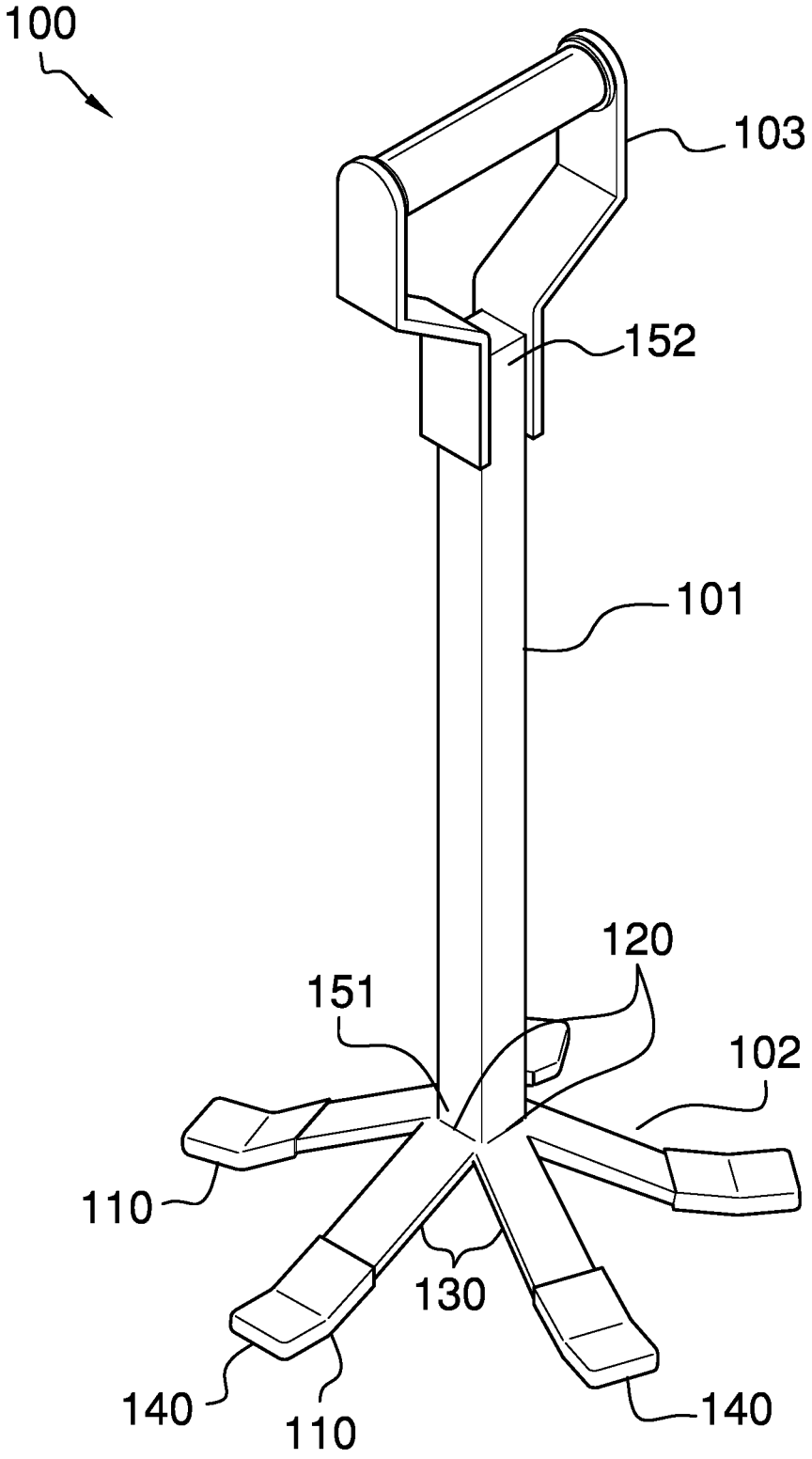
FIG. 1 is a perspective view of an embodiment of the disclosure.
Figure 2:
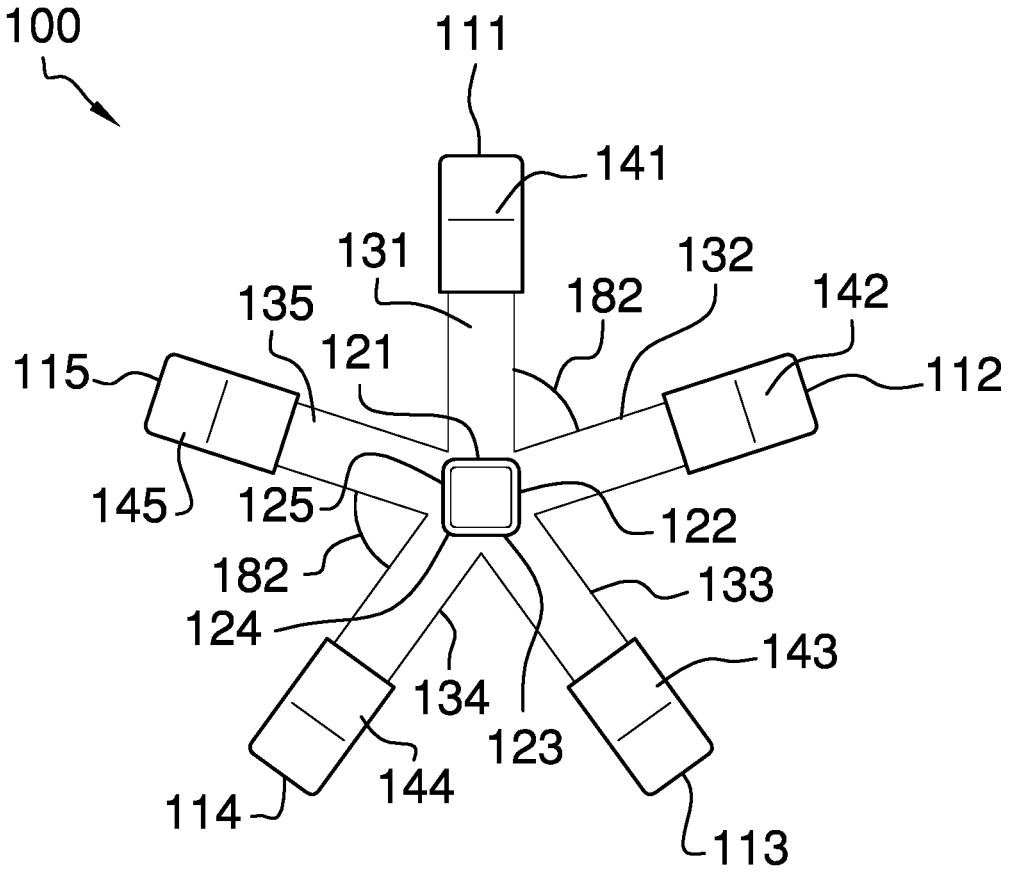
FIG. 2 is a bottom view of an embodiment of the disclosure.
Figure 3:
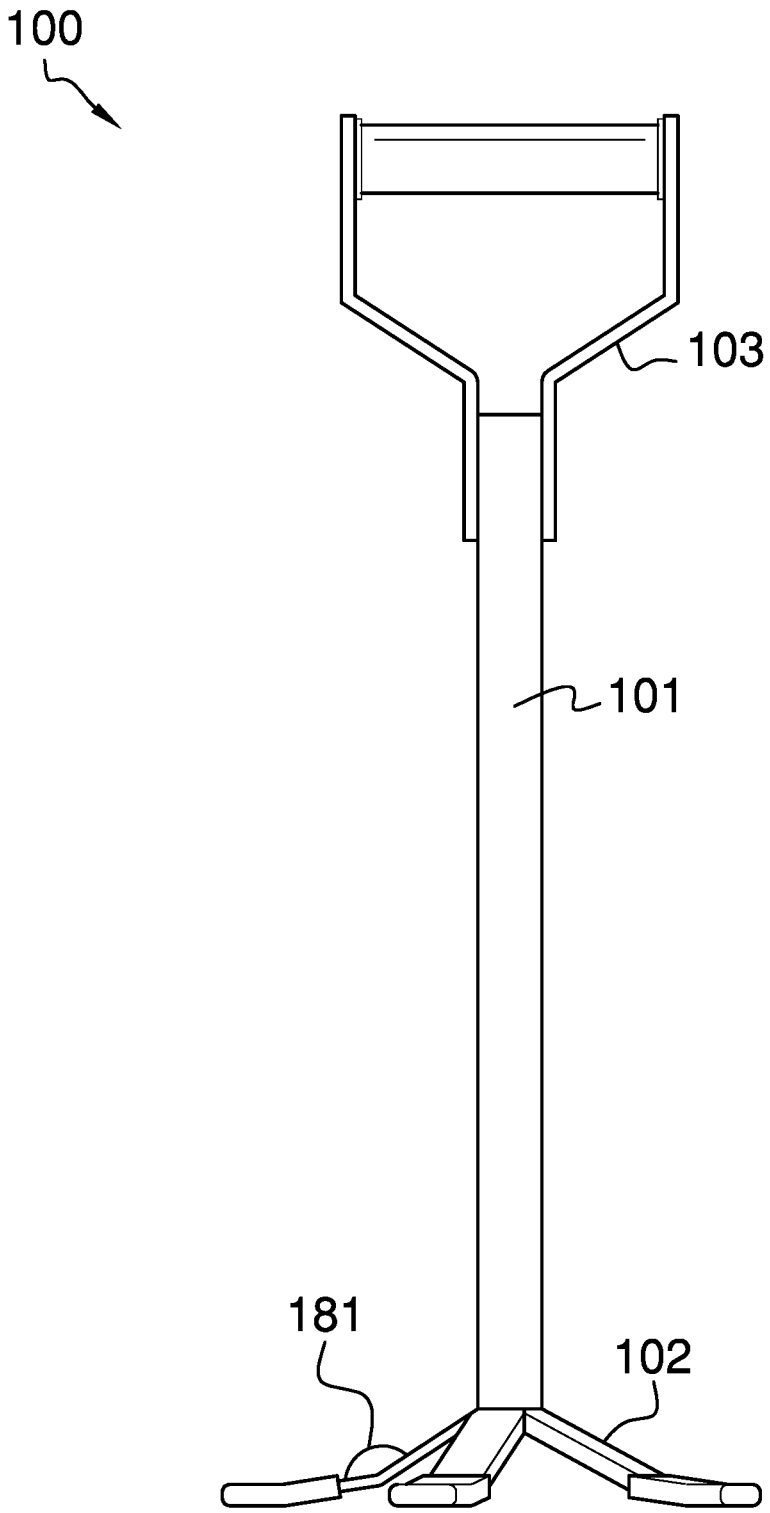
FIG. 3 is a side view of an embodiment of the disclosure.
Figure 4:
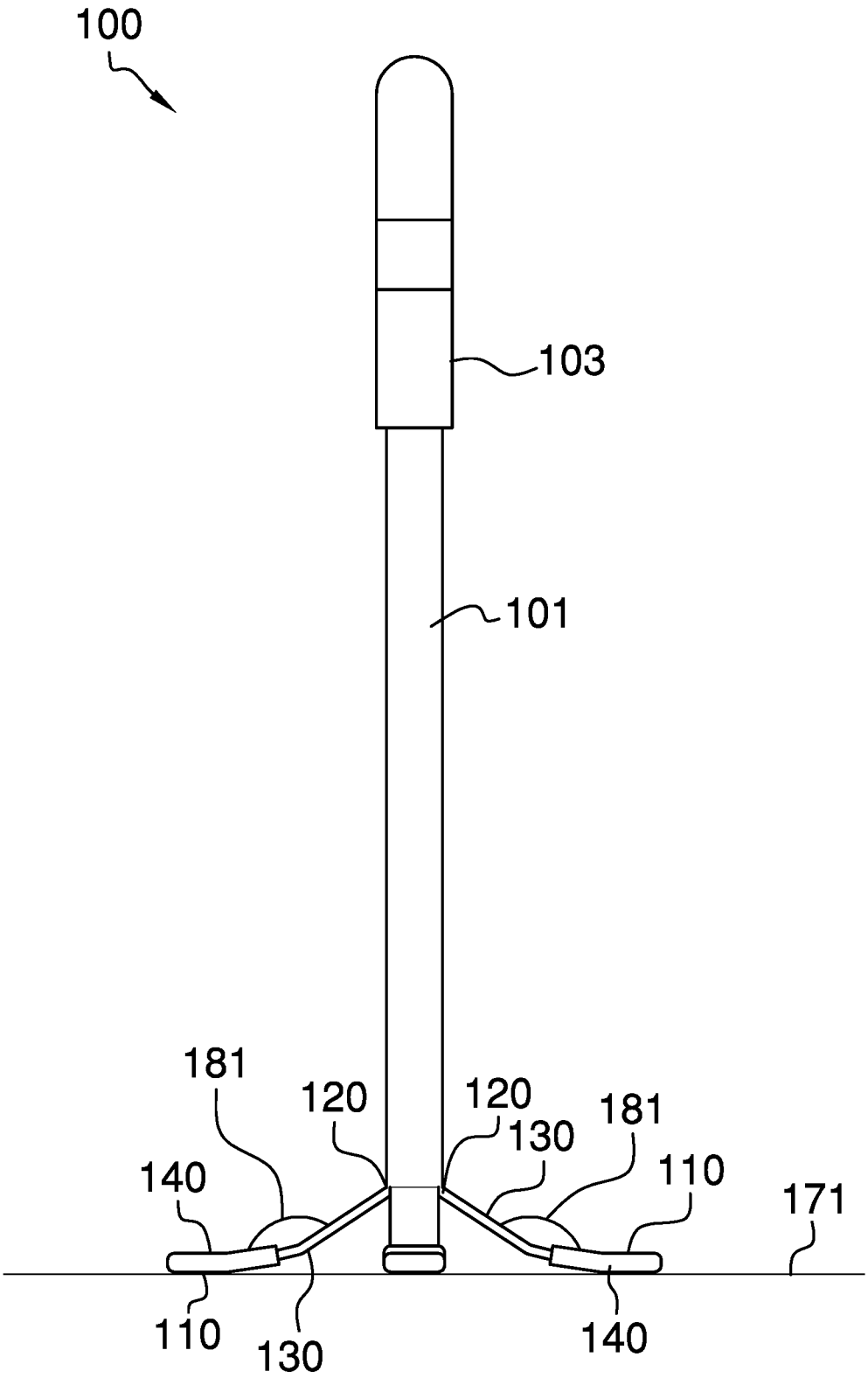
FIG. 4 is a front view of an embodiment of the disclosure.
Figure 5:
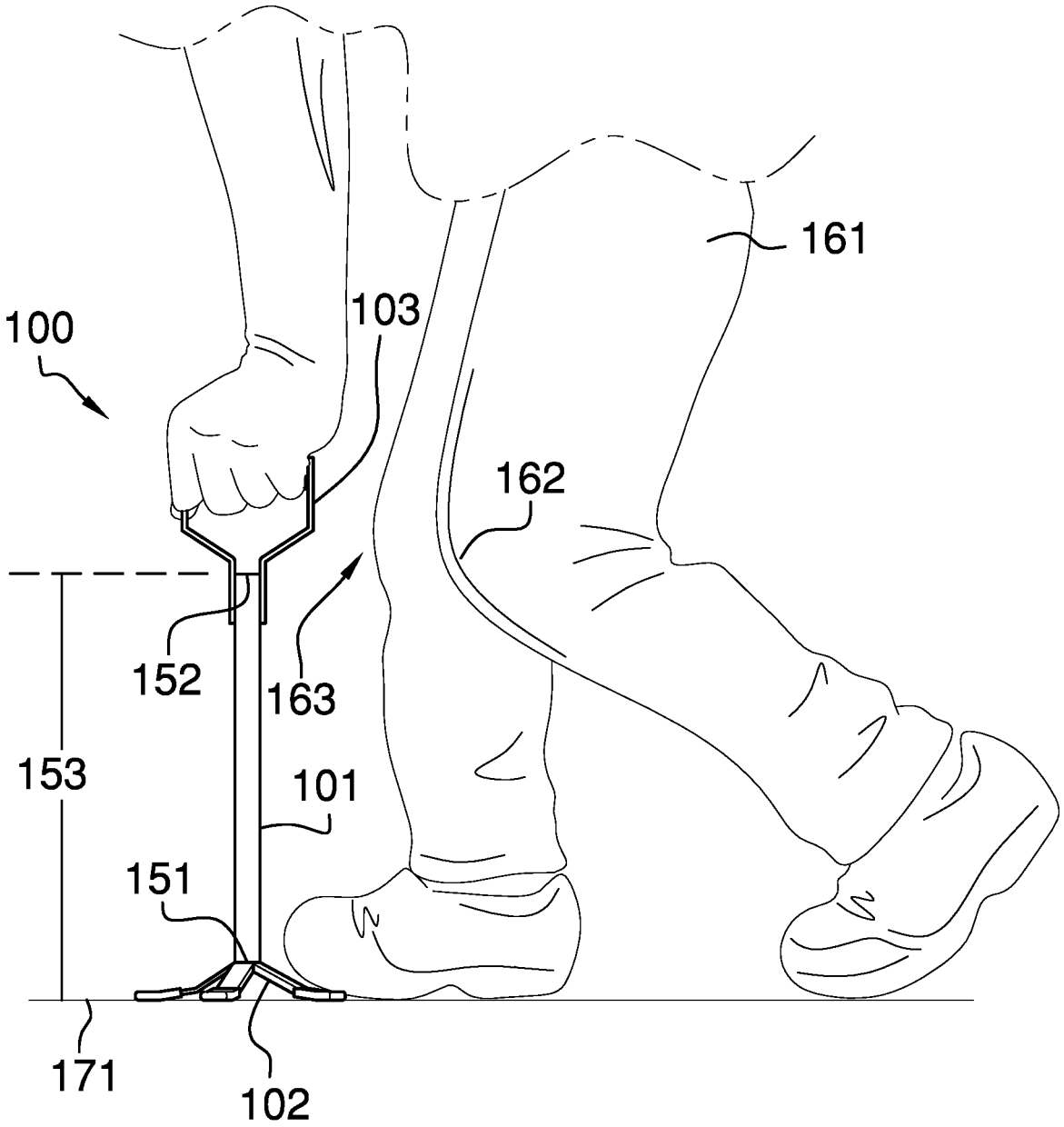
FIG. 5 is an in-use view of an embodiment of the disclosure.

Detailed reference will now be made to one or more potential embodiments of the disclosure, which are illustrated in FIGS. 1 through 5.

The standing aid 100 (hereinafter invention) is a mobility assistance device. The invention 100 is configured for use with a person 161. The person 161 is further defined with a knee. The knee 162 is further defined with a patella 163. The invention 100 assists a person 161 as the person 161 moves in a manner selected from the group consisting of: 1) moving from a standing position to a kneeling position; and 2) moving from a kneeling position to a standing position. The invention 100 allows a person 161 to transfer some of the load of their body to the supporting surface 171 through a load path created by the invention 100. This transfer allows a person 161 to more easily move in the selected manner. The invention 100 comprises a stanchion 101, a plurality of supporting legs 102, and a handle 103. The plurality of supporting legs 102 and the handle 103 attach to the stanchion 101. The invention 100 is further defined with a vertical span 153. The vertical span 153 is described in greater detail elsewhere in this disclosure.

The stanchion 101 is a prism-shaped shaft. The stanchion 101 is an extension structure that extends the distance between the plurality of supporting legs 102 and the handle 103. The stanchion 101 forms a load path that transfers the load presented by the person 161 through the handle 103 to the plurality of supporting legs 102. The stanchion 101 forms the bulk of the vertical span 153 of the invention 100. The stanchion 101 is further defined with an inferior end 151 and a superior end 152.

The vertical span 153 refers to the vertical distance of the invention 100 from the supporting surface 171 to the superior end 152 of the stanchion 101. The vertical span 153 selected for the invention 100 is adapted to the person 161 using the invention 100. Specifically, the span of the center axis of the stanchion 101 is selected such that the vertical span 153 is not significantly different from a reference vertical span which is measured from the supporting surface 171 to the inferior edge of the patella 163 of the knee 162 of the person 161 using the invention 100. The reference vertical span is measured when the person 161 is standing.

The plurality of supporting legs 102 form a stand that raises the inferior end 151 of the stanchion 101 above the supporting surface 171. The plurality of supporting legs 102 comprises a collection of individual supporting legs 110. Each of the plurality of supporting legs 102 transfers a portion of the load path formed by the invention 100 from the inferior end 151 of the stanchion 101 to the supporting surface 171. Each individual supporting leg 110 selected from the plurality of supporting legs 102 projects radially away from the center axis of the stanchion 101. The plurality of supporting legs 102 is further defined with a separation angle 182.

Any first individual supporting leg 110 selected from the plurality of supporting legs 102 is separated from any second adjacent individual supporting leg 110 selected from the plurality of supporting legs 102 by a separation angle 182. The vertex of the separation angle 182 is located on the center axis of the stanchion 101. The separation angle 182 between any two adjacent individual supporting legs 110 selected from the plurality of supporting legs 102 is identical.

Each individual supporting leg 110 is identical. Each individual supporting leg 110 attaches to the inferior end 151 of the stanchion 101 in the manner of a cantilever. Each individual supporting leg 110 projects radially away from the center axis of the stanchion 101.

Each individual supporting leg 110 acts as a spring. Specifically, when a force is applied in the vertical direction to the surface of each individual supporting leg 110, the elasticity of each individual supporting leg 110 creates a rotational torque that opposes the displacement created by rotating each individual supporting leg 110 around a pivot point located at the individual joint 120 where each individual supporting leg 110 is attached to the stanchion 101. This rotational torque places a strain on each individual supporting leg 110 such that the force of the strain is in the direction that returns each individual supporting leg 110 to its original position. This spring-like action of each of the individual supporting legs 110 helps to maintain the stability of the invention 100 when a person 161 applies an errant or inadvertent lateral force to the handle 103 of the invention 100.

Each individual supporting leg 110 comprises an individual joint 120, an individual gusset 130, and an individual pedestal 140. Each individual supporting leg 110 is further defined with a cant angle 181.

The individual joint 120 attaches each individual supporting leg 110 to the inferior end of the stanchion 101. Methods to form the individual joint 120 are well-known and documented in the mechanical arts. Such methods include, but are not limited to, welding, the use of hardware, or molding each individual supporting leg 110 on the stanchion 101 as an integrated unit.

The individual gusset 130 is a plate structure that attaches the individual joint 120 to the individual pedestal 140. The individual gusset 130 is an extension structure that extends the distance between the individual joint 120 and the individual pedestal 140. The individual gusset 130 forms the cantilever structure of the individual supporting leg 110. The individual gusset 130 projects radially away from the center axis of the stanchion 101 at an angle that is not perpendicular to the center axis of the stanchion 101. The individual gusset 130 is formed as a semi-rigid structure with an elastic nature.

The individual gusset 130 forms a cant angle 181 with the individual pedestal 140. The cant angle 181 formed by the individual gusset 130 and the individual pedestal 140 allows the individual gusset 130 to perform the spring function of the individual supporting leg 110 while allowing the individual pedestal 140 to remain securely in contact with the supporting surface 171. The individual pedestal 140 is a plate structure that attaches to the free end of the individual gusset 130.

The cant angle 181 is selected such that the plane formed by the surface of the face of the individual pedestal 140 with the largest surface area is perpendicular to the center axis of the stanchion 101.

The individual pedestal 140 is a pedestal that forms the final link of a load path that transfers a portion of the load borne by the invention 100 to the supporting surface 171. The individual pedestal 140 is coated with a non-skid material. The non-skid material prevents the individual pedestal 140 from sliding along the supporting surface 171 while the invention 100 is bearing a load.

The handle 103 is a grip that attaches to the superior end 152 of the stanchion 101. In the first potential embodiment of the disclosure, the handle 103 is a commercially available D grip commonly used as a handle on a hand tool.

The plurality of supporting legs 102 comprises a first supporting leg 111, a second supporting leg 112, a third supporting leg 113, a fourth supporting leg 114, and a fifth supporting leg 115.

The first supporting leg 111 comprises a first joint 121, a first gusset 131, and a first pedestal 141. The first joint 121 is the individual joint 120 that attaches the first supporting leg 111 to the inferior end 151 of the stanchion 101. The first gusset 131 is the individual gusset 130 that attaches the first pedestal 141 to the first joint 121. The first pedestal 141 is the element of the first supporting leg 111 that transfers the load path borne by the first supporting leg 111 to the supporting surface 171. The first pedestal 141 attaches to the free end of the first gusset 131.

The second supporting leg 112 comprises a second joint 122, a second gusset 132, and a second pedestal 142. The second joint 122 is the individual joint 120 that attaches the second supporting leg 112 to the inferior end 151 of the stanchion 101. The second gusset 132 is the individual gusset 130 that attaches the second pedestal 142 to the second joint 122. The second pedestal 142 is the element of the second supporting leg 112 that transfers the load path borne by the second supporting leg 112 to the supporting surface 171. The second pedestal 142 attaches to the free end of the second gusset 132.

The third supporting leg 113 comprises a third joint 123, a third gusset 133, and a third pedestal 143. The third joint 123 is the individual joint 120 that attaches the third supporting leg 113 to the inferior end 151 of the stanchion 101. The third gusset 133 is the individual gusset 130 that attaches the third pedestal 143 to the third joint 123. The third pedestal 143 is the element of the third supporting leg 113 that transfers the load path borne by the third supporting leg 113 to the supporting surface 171. The third pedestal 143 attaches to the free end of the third gusset 133.

The fourth supporting leg 114 comprises a fourth joint 124, a fourth gusset 134, and a fourth pedestal 144. The fourth joint 124 is the individual joint 120 that attaches the fourth supporting leg 114 to the inferior end 151 of the stanchion 101. The fourth gusset 134 is the individual gusset 130 that attaches the fourth pedestal 144 to the fourth joint 124. The fourth pedestal 144 is the element of the fourth supporting leg 114 that transfers the load path borne by the fourth supporting leg 114 to the supporting surface 171. The fourth pedestal 144 attaches to the free end of the fourth gusset 134.

The fifth supporting leg 115 comprises a fifth joint 125, a fifth gusset 135, and a fifth pedestal 145. The fifth joint 125 is the individual joint 120 that attaches the fifth supporting leg 115 to the inferior end 151 of the stanchion 101. The fifth gusset 135 is the individual gusset 130 that attaches the fifth pedestal 145 to the fifth joint 125. The fifth pedestal 145 is the element of the fifth supporting leg 115 that transfers the load path borne by the fifth supporting leg 115 to the supporting surface 171. The fifth pedestal 145 attaches to the free end of the fifth gusset 135.

The following definitions were used in this disclosure:

Cant: As used in this disclosure, a cant is an angular deviation from one or more reference lines (or planes) such as a vertical line (or plane) or a horizontal line (or plane).

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Coating: As used in this disclosure, a coating refers to a substance applied to the exterior surface of an object such that the coating forms a new exterior surface of the object. A coating is commonly said to be formed as a layer. Paint is an example of a common coating material.

Correspond: As used in this disclosure, the term correspond means that a first object is in some manner linked to a second object in a one to one relationship.

Elastic: As used in this disclosure, an elastic is a material or object that deforms when a force is applied to it and that is able to return to its relaxed shape after the force is removed. A material that exhibits these qualities is also referred to as an elastomeric material.

Extension Structure: As used in this disclosure, an extension structure is an inert physical structure that is used to extend the span of the distance between any two objects.

Force of Gravity: As used in this disclosure, the force of gravity refers to a vector that indicates the direction of the pull of gravity on an object at or near the surface of the earth.

Grip: As used in this disclosure, a grip is an accommodation formed on or within an object that allows the object to be grasped or manipulated by a hand.

Gusset: As used in this disclosure, a gusset is an angled structural member used to form a portion of the load path of a section of a framework. By angled is meant that the gusset is neither parallel nor perpendicular to the force of gravity.

Handle: As used in this disclosure, a handle is an object by which a tool, object, or door is held or manipulated with the hand.

Hardware: As used in this disclosure, refers to a one or more incidental objects: 1) that are readily and commercially available; and, 2) that are associated with the installation, operation or maintenance of a primary object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Incidental: As used in this disclosure, incidental refers to a second object that is associated with a first object but that: 1) does not significantly affect the characteristics of the first object; and, 2) the function of which can be readily replaced by or substituted with a third object.

Inferior: As used in this disclosure, the term inferior refers to a directional reference that is parallel to and in the same direction as the force of gravity.

Load: As used in this disclosure, the term load refers to an object upon which a force is acting or which is otherwise absorbing or transferring energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Non-Skid Material: As used in this disclosure, a non-skid material is a material or structure that can be applied to an object such that the object is inhibited from sliding along the surface upon which the object is resting. Non-skid materials are often, but not always, adhesive, elastic, or abrasive materials.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

Pedestal: As used in this disclosure, a pedestal is an intermediary load bearing structure that that transfers a load path between a supporting surface and an object, structure, or load.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk-like appearance. As defined in this disclosure, plates may be made of any material, but are commonly made of metal, plastic, and wood. When made of wood, a plate is often referred to as a board.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Relaxed Shape: As used in this disclosure, a structure is considered to be in its relaxed state when no shear, strain, or torsional forces are being applied to the structure.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Stanchion: As used in this disclosure, a stanchion refers to a vertical pole, post, or support.

Superior: As used in this disclosure, the term superior refers to a directional reference that is parallel to and in the opposite direction of the force of gravity.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A mobility assistance device comprising:

a stanchion, a plurality of supporting legs, and a handle;

wherein the plurality of supporting legs and the handle attach to the stanchion;

wherein the mobility assistance device is further defined with a vertical span;

wherein the mobility assistance device is configured for use with a person;

wherein the mobility assistance device is adapted to assist a person in moving from either a standing position or a kneeling position to a kneeling position or a standing position, respectively;

wherein the mobility assistance device is adapted to allow said person to transfer a portion of the load of a body of said person to the supporting surface through a load path created by the mobility assistance device;

wherein the mobility assistance device is configured for use with a supporting surface;

wherein the plurality of supporting legs comprises a collection of individual supporting legs;

wherein each individual supporting leg selected from the plurality of supporting legs projects radially away from the center axis of the stanchion;

wherein the plurality of supporting legs is further defined with a separation angle;

wherein each individual supporting leg comprises an individual joint, an individual gusset, and an individual pedestal;

wherein each individual supporting leg is further defined with a cant angle;

wherein the individual gusset attaches the individual pedestal to the individual joint;

wherein the individual pedestal is a plate structure that attaches to the free end of the individual gusset;

wherein the individual gusset forms the cant angle with the individual pedestal;

wherein the cant angle is selected such that the plane formed by the surface of the face of the individual pedestal with the largest surface area is perpendicular to the center axis of the stanchion.

2. The mobility assistance device according to claim 1 wherein the stanchion is a prism-shaped shaft;

wherein the stanchion is an extension structure that extends a distance between the plurality of supporting legs and the handle;

wherein the stanchion is further defined with an inferior end and a superior end.

3. The mobility assistance device according to claim 2 wherein the plurality of supporting legs form a stand that raises the inferior end of the stanchion above the supporting surface.

4. The mobility assistance device according to claim 3 wherein the vertical span is the vertical distance of the mobility assistance device from the supporting surface to the superior end of the stanchion;

wherein span of the vertical span selected for the mobility assistance device is adapted to the person;

wherein the span of the center axis of the stanchion is selected such that span of the vertical span is not significantly different from a reference vertical span that is adapted to be measured from the supporting surface to the inferior edge of a patella of a knee of the person using the mobility assistance device;

wherein the reference vertical span is adapted to be measured when the person is standing.

5. The mobility assistance device according to claim 4 wherein each individual supporting leg is identical.

6. The mobility assistance device according to claim 5 wherein any first individual supporting leg selected from the plurality of supporting legs is separated from any second adjacent individual supporting leg selected from the plurality of supporting legs by the separation angle;

wherein a vertex of the separation angle is located on the center axis of the stanchion;

wherein the separation angle between any two adjacent individual supporting legs selected from the plurality of supporting legs is identical.

7. The mobility assistance device according to claim 6 wherein each individual supporting leg attaches to the inferior end of the stanchion in the manner of a cantilever.

8. The mobility assistance device according to claim 7 wherein each individual supporting leg projects radially away from the center axis of the stanchion.

9. The mobility assistance device according to claim 8 wherein each individual supporting leg forms a spring.

10. The mobility assistance device according to claim 9 wherein each individual joint attaches each individual supporting leg to the inferior end of the stanchion.

11. The mobility assistance device according to claim 10 wherein the individual gusset forms a cantilever structure;

wherein the individual gusset is formed as a semi-rigid structure with an elastic nature;

wherein the individual gusset is an extension structure that extends the distance between the individual joint and the individual pedestal.

12. The mobility assistance device according to claim 11 wherein the individual gusset projects radially away from the center axis of the stanchion at an angle that is not perpendicular to the center axis of the stanchion.

13. The mobility assistance device according to claim 12 wherein the individual pedestal is coated with a non-skid material;

wherein the individual pedestal is a pedestal that forms the final link of a load path that transfers a portion of the load borne by the mobility assistance device to the supporting surface.

14. The mobility assistance device according to claim 13 wherein the handle is a grip that attaches to the superior end of the stanchion.

15. The mobility assistance device according to claim 14 wherein the plurality of supporting legs comprises a first supporting leg, a second supporting leg, and a third supporting leg;

wherein the first supporting leg comprises a first joint, a first gusset, and a first pedestal;

wherein the first joint is the individual joint that attaches the first supporting leg to the inferior end of the stanchion;

wherein the first gusset is the individual gusset that attaches the first pedestal to the first joint;

wherein the first pedestal attaches to the free end of the first gusset;

wherein the second supporting leg comprises a second joint, a second gusset, and a second pedestal;

wherein the second joint is the individual joint that attaches the second supporting leg to the inferior end of the stanchion;

wherein the second gusset is the individual gusset that attaches the second pedestal to the second joint;

wherein the second pedestal attaches to the free end of the second gusset;

wherein the third supporting leg comprises a third joint, a third gusset, and a third pedestal;

wherein the third joint is the individual joint that attaches the third supporting leg to the inferior end of the stanchion;

wherein the third gusset is the individual gusset that attaches the third pedestal to the third joint;

wherein the third pedestal attaches to the free end of the third gusset.

16. The mobility assistance device according to claim 15 wherein the plurality of supporting legs further comprises a fourth supporting leg;

wherein the fourth supporting leg comprises a fourth joint, a fourth gusset, and a fourth pedestal;

wherein the fourth joint is the individual joint that attaches the fourth supporting leg to the inferior end of the stanchion;

wherein the fourth gusset is the individual gusset that attaches the fourth pedestal to the fourth joint;

wherein the fourth pedestal attaches to the free end of the fourth gusset.

17. The mobility assistance device according to claim 16 wherein the plurality of supporting legs further comprises a fifth supporting leg;

wherein the fifth supporting leg comprises a fifth joint, a fifth gusset, and a fifth pedestal;

wherein the fifth joint is the individual joint that attaches the fifth supporting leg to the inferior end of the stanchion;

wherein the fifth gusset is the individual gusset that attaches the fifth pedestal to the fifth joint;

wherein the fifth pedestal attaches to the free end of the fifth gusset.

* * * * *